US005749183A

United States Patent [19]

Wright

[11] Patent Number: 5,749,183

[45] Date of Patent: May 12, 1998

[54] BAY OR BOW WINDOW SUPPORT SYSTEM

[76] Inventor: William Wright, 163 Kiel Ave., Butler, N.J. 07405

[21] Appl. No.: 743,384

[22] Filed: Nov. 4, 1996

[51] Int. Cl.[6] ..... E06B 1/38

[52] U.S. Cl. ..... 52/201; 52/210; 52/217; 52/122.1; 52/126.1; 248/323

[58] Field of Search ..... 52/201, 210, 217, 52/122.1, 123.1, 126.1, 127.1, 127.7; 248/323, 327

[56] References Cited

U.S. PATENT DOCUMENTS

| | | | |
|---|---|---|---|
| 1,214,057 | 1/1917 | Moore | 52/201 X |
| 3,528,634 | 9/1970 | Jenkins | 248/327 X |
| 5,001,875 | 3/1991 | Cacioppo | 52/201 |

*Primary Examiner*—Wynn E. Wood
*Assistant Examiner*—Laura A. Callo
*Attorney, Agent, or Firm*—Anthony D. Cipollone, Esq.

[57] ABSTRACT

A window support system for a bay or bow window to be installed on a home or other building wherein the system is secured to the head board and seat board of the unit and wherein the system comprises a vertically extending hollow pipe or solid rod disposed between inner and outer panes of glass which is secured in place by means of standard fastening devices both to the head board and seat board and wherein a turnbuckle is disposed between two threaded rods and at an angle of preferably 22½ or 45 degrees from the head board. A standard pipe elbow is employed between the vertically extending rod or tool and the threaded rod to maintain the angle to the head board. An eye bolt is affixed to the existing house header and a second threaded rod having a hook on one end, distant from the turnbuckle, for cooperation with the eye bolt. Upon installation of the window the turnbuckle can therefore be rotated in either direction to properly level and secure the window to the house.

5 Claims, 2 Drawing Sheets

BAY OR BOW WINDOW SUPPORT SYSTEM

BACKGROUND OF INVENTION

1. Field of the Invention

The present invention generally involves the field of technology pertaining to a device to be mounted, preferably, to a bay or bow window installed on a home or other building for the purpose of securing that window in place. The bay or bow window is of the type having an inner and outer pane and wherein a hollow channel extends between corner posts and, wherein, in turn, a vertically extending hollow pipe or a solid rod extends vertically throughout the entire length of the hollow channel.

In general, the window support system comprises a horizontally extending solid angle iron attached to a seat board of the bay or bow window and secured thereto by any well known fastening device such as the combination of a flat washer, lock washer, and nut.

The previously mentioned vertically extending rod or pipe extends through the seat board and one flange of the solid angle iron and then secured in place as discussed.

The upper end of the vertically extending rod extends through a head board of the bay or bow window and is similarly secured thereto by way of a standard fastening device comprising the same combination of a flat washer, lock washer, and nut.

From there, a combination of two threaded rods having disposed between them a turnbuckle is operatively connected to the vertically extending rod by means of a standard pipe elbow preferably at a 22½ or 45 degree angle and in turn one end of one of the threaded rods, distant from the turnbuckle, has an eye hook, which in turn hooks onto an eye bolt which in turn is secured to the existing house header. The turnbuckle can then be rotated in either direction to help level and keep in place the window unit. It is seen that a pair of the support devices are required with the exception of one solid angle iron to which both are attached.

2. Description of the Prior Art

A search of the prior art has uncovered the following U.S. Pat. Nos.: 2,690,792 to J. C. Eriksen; 3,148,479 to C. D'Amato; 4,103,466 to Nagase; 4,643,246 to Ikemura et al.; and, 5,001,875 to Cacioppo.

The patent to Cacioppo, 5,001,875 essentially relates to a roof structure for a bay or bow type window assembly. This patent does not teach the unique combination of the threaded rods, turnbuckle, and eye bolt of the instant invention. Further, no vertically extending pipe or rod within the window unit itself is shown.

Ikemura, et al., 4,643,246 relates to a bay window with a ventilator wherein the window unit itself is "composed of a pair of horizontal sliding window sashes 26, 27 which are horizontally slidable along the outer head 17 in the outer transom 18." Thus, this would have no applicability to the window type shown in the instant application.

The patent to Nagase, 4,103,466 relates to a bay window unit wherein the unit is adapted to cover an opening in a building wall. This patent also does not teach the unique combination of the eye bolt, turnbuckle, angularly placed threaded rods, nor the vertically extending rod or pipe.

The patent to Eriksen, 2,690,797 relates to a cab window, again, not comprising the unique hardware of the instant invention.

Finally, the patent to D'Amato, 3,148,479 relates to a window greenhouse and components therefor and also does not disclose the unique combination, as disclosed in the instant invention, of a vertically extending rod or pipe disposed between two window panes, a solid angle iron connecting the support members to a seat board, nor the hardware comprising the threaded rods and turnbuckles as described.

None of the above references teaches or even suggests the use of vertically extending rods or pipes disposed in the hollow channel disposed between two window panes wherein the lower portions of the vertically extending members are secured, through means of a solid angle iron, to a seat board of a bay window nor the unique combination of elements disposed at an angle to the head board for attaching and securing the support units to an existing house header.

SUMMARY OF THE INVENTION

According to the present invention a window support system is provided for mounting and holding in place a bay or bow window to an existing home or other structure.

Vertically extending hollow cylinders, pipes, or solid metal rods are disposed between an outer and inner window pane of a bay or bow window and are secured in place within such space by means of any well known fastening devices such as a combination of a flat washer, lock washer, and nut. Such vertically extending unit extends through both the head board and seat board of the window.

At the lower end the vertically extending member extends through the seat board of the bay or bow window and through one flange of a horizontal extending solid angle iron where it is secured in place by, again, any well known fastening device.

An eye bolt is inserted into an existing house header at a point above the head board of the window and the eye end in turn engages the hook end of a threaded rod the other end of which is operatively associated with one opening in a turnbuckle. Extending through another opening at the other end of the turnbuckle is a threaded rod whose other end connects with a standard pipe elbow at some desired angle, such as 22½ or 45 degrees, whereby the entire sub-assembly comprising the eye bolt, first and second threaded rods, turnbuckle, and pipe elbow are always maintained at a fixed angle to the head board of the bay or bow window.

With all of the elements in place, and when it is desired to secure the window to the structure, the turnbuckle can be rotated in either a clockwise or counter-clockwise direction to level the window and firmly hold it in place.

It is therefore an object of the invention to provide a window support system.

It is another of the invention to provide a window support system for a bay or bow window.

It is a further object of the invention to provide such a window support system for a bay or bow window wherein either solid rods or hollow tubing extend vertically throughout the windows and are secured to the seat board of such window by means of a horizontally extending solid angle iron.

It is still a further object of the invention to provide such a window support system wherein a turnbuckle is provided between a first and second piece of threaded rod for leveling and holding in place such a bay or bow window.

These and further objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

A device to be mounted on and with a bay or bow window for securing such window to a house or other structure will now be described with reference to FIGS. 1 and 2 of the drawings.

Figure 1:
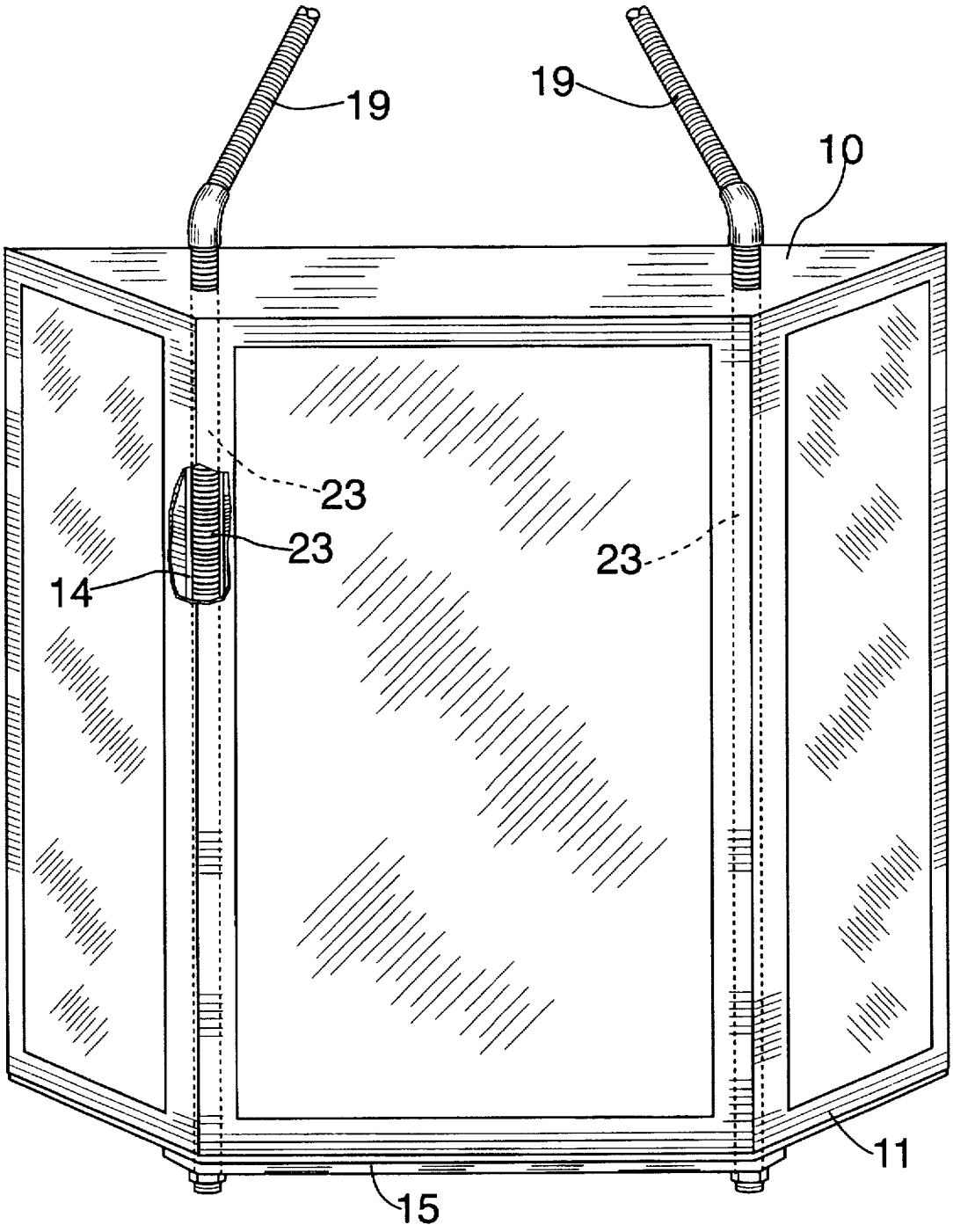
FIG. 1 is a front view of a bay or bow window showing the vertically extending rods, solid angle iron mounting device at the bottom, and, partially showing the threaded rod at an angle to the head board.

A bay or bow window shown generally at 5 comprises a front panel 6 side panels 7 and 8 corner post 9 head board 10 and seat board 11 all assembled as specifically shown in FIG. 1.

Item 5 comprising elements 6–11 are all well-known parts of a bay or bow window to be secured to a house or other structure.

12 and 13 represent respectively the existing house header and house structure into which the bay or bow window is to be installed and attached.

A horizontally extending strip of angle iron shown at 15 extends across the seat board 11 and is secured thereto by means of any well known fastening device such as the combination of a flat washer, lock washer and nut shown generally at 16 for purposes to be more fully described below.

Figure 2:
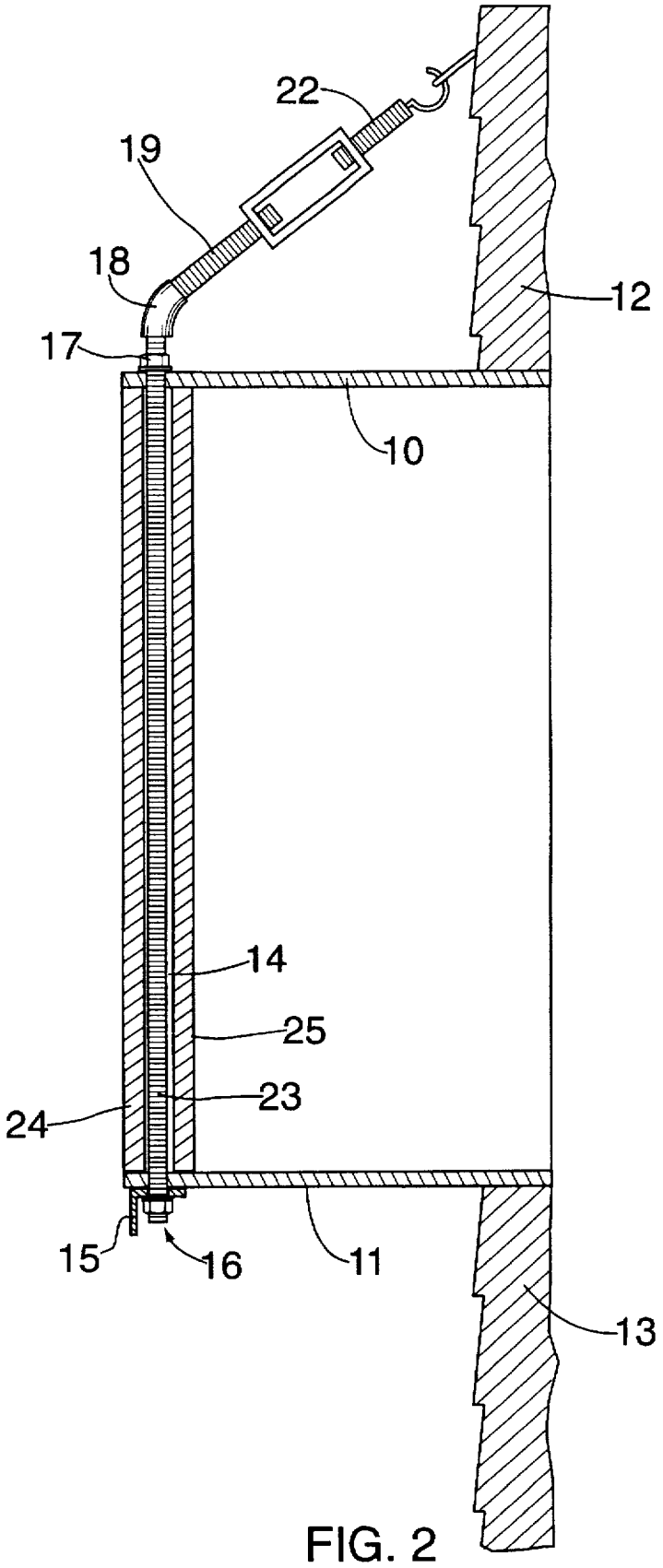
FIG. 2 is a side view, taken in section, further showing the eye bolt, two threaded rods, and turnbuckle connecting the vertically extending member to the existing house header.

Extending vertically, between head board 10 and seat board 11 is rod 23 which is disposed in the space between outer and inner window panes 24 and 25 as clearly seen in FIG. 2. The lower end of rod 23 extends through the seat board 11 and through one flange of the angle iron as shown in FIG. 2 where it is secured to both the angle iron and seat board by fastening device 16 as previously discussed.

The opposite end of vertically extending rod 23 extends up through head board 10 and is held in place by means of a suitable fastening device such as the combination of a flat washer, lock washer, and nut shown generally at 17.

A suitable pipe elbow of perhaps 22½ degrees or 45 degrees is then secured to the upper end of vertically extending rod 23 after it extends through the head board and fastening device.

A threaded rod 19 engages the other end of the standard pipe elbow and therefore is disposed at the same angle from the head board as the angle of the pipe elbow. A standard turnbuckle 20 is then threadably secured to the distil end of the threaded rod. The other end of the turnbuckle 20 threadably engages a second threaded rod 22 having a hook 26 which in turn engages an eye 27 of eye bolt 21 which is fixedly secured to existing house header 12.

In operation, with all of the elements in place as shown in FIG. 2, in order to properly level the head board, seat board, and the basic window unit itself and to secure that window in place, the turnbuckle can be rotated which will allow greater or lesser slack to the rod supports.

Though the invention has been described and illustrated with reference to a preferred embodiment thereof, those skilled in the art will appreciate that various changes and modifications in shape, size, composition and arrangement of parts may be resorted to without departing from the spirit of the invention or scope of the subjoined claims.

What is claimed is:

1. A window support system securing a bay window to a structure having a house header, head board, and a seat board, the improvement comprising:

(a) two vertically extending spaced apart glass panes;

(b) a pair of vertically extending parallel and spaced apart rods disposed between said glass panes and extending the entire length thereof;

(c) a horizontally extending support member extending across the bottom of said seat board;

(d) fastening means securing said horizontally extending support member and said pair of vertically extending rods to said seat board;

(e) fastening means securing said pair of vertically extending support rods to said head board;

(f) a pipe elbow disposed about the upper end of said vertically extending rods;

(g) a first rod threadably engaging another opening in said pipe elbow;

(h) a turnbuckle threadably engaging the other end of said first rod;

(i) a second rod threadably engaging the distal end of said turnbuckle;

(j) a bolt disposed in said house header; and (k) means attaching said bolt to said second rod whereby when said turnbuckle is rotated in either a clockwise or counter-clockwise direction the window support system gives up or takes up slack for the purpose of leveling and securing the bay window.

2. The window support system of claim 1 wherein said horizontally extending support member is an angle iron.

3. The window support system of claim 1 wherein said fastening means securing said vertically extending rods both to said head board and to said seat board is a combination of a flat washer, lock washer and nut.

4. The window support system of claim 1 wherein said bolt disposed in said house header is an eye bolt.

5. The window support system of claim 1 wherein said means attaching said bolt to said second rod is a hook formed on one end of said second rod engaging an eye formed on one end of said eye bolt.

* * * * *